US009677318B2

(12) United States Patent
Rosales et al.

(10) Patent No.: US 9,677,318 B2
(45) Date of Patent: Jun. 13, 2017

(54) HATCH ARRANGEMENT FOR A MOTOR VEHICLE

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US); Stepan Hanke, Lake Orion, MI (US); Linda Loeffler, Lake Orion, MI (US); Mark Swanson, Auburn Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 14/832,236

(22) Filed: Aug. 21, 2015

(65) Prior Publication Data

US 2016/0052376 A1 Feb. 25, 2016

Related U.S. Application Data

(60) Provisional application No. 62/040,227, filed on Aug. 21, 2014.

(51) Int. Cl.

| | |
|---|---|
| ***E05F 11/08*** | (2006.01) |
| ***E05F 15/70*** | (2015.01) |
| ***E05B 81/20*** | (2014.01) |
| ***E05F 15/622*** | (2015.01) |
| *E05F 7/04* | (2006.01) |

(52) U.S. Cl.

CPC ..... *E05F 15/70* (2015.01); *E05B 81/20* (2013.01); *E05F 15/622* (2015.01); *E05F 7/04* (2013.01); *E05Y 2201/22* (2013.01); *E05Y 2201/232* (2013.01); *E05Y 2800/10* (2013.01); *E05Y 2900/546* (2013.01)

(58) Field of Classification Search

CPC ... B60J 5/101; E05C 3/12; E05F 15/70; E05F 7/04; E05F 15/614; E05D 7/00

USPC ..... 49/339, 340, 344

See application file for complete search history.

(56) References Cited

U.S. PATENT DOCUMENTS

| | | | | |
|---|---|---|---|---|
| 4,806,712 | A * | 2/1989 | Hoffman et al. | 200/61.62 |
| 5,639,130 | A * | 6/1997 | Rogers et al. | 292/216 |
| 5,938,252 | A * | 8/1999 | Uemura et al. | 292/201 |
| 6,053,542 | A * | 4/2000 | Ostrowski et al. | 292/201 |
| 6,123,372 | A * | 9/2000 | Rogers et al. | 292/216 |
| 6,125,583 | A * | 10/2000 | Murray et al. | 49/291 |
| 6,256,932 | B1 * | 7/2001 | Jyawook et al. | 49/503 |
| 6,382,687 | B1 * | 5/2002 | Gruhn | 292/201 |

(Continued)

FOREIGN PATENT DOCUMENTS

DE 202012004789 10/2013

*Primary Examiner* — Jerry Redman

(74) *Attorney, Agent, or Firm* — Pauly, Devries Smith & Deffner, LLC

(57) ABSTRACT

The invention is directed to a hatch arrangement for a motor vehicle, the hatch arrangement having a hatch leaf movable between an open hatch position and a closed hatch position, and a cinching catch for engaging a cinching striker of the motor vehicle, which cinching catch is movably coupled to the hatch leaf, and a hatch drive arrangement for moving the hatch leaf. The hatch drive arrangement is coupled with the cinching catch for moving the cinching catch. The invention is also directed to a hatch drive arrangement for such a hatch arrangement.

19 Claims, 5 Drawing Sheets

(56) References Cited

U.S. PATENT DOCUMENTS

| | | | | |
|---|---|---|---|---|
| 6,435,600 | B1 * | 8/2002 | Long et al. | 296/155 |
| 6,505,867 | B1 * | 1/2003 | Szablewski et al. | 292/201 |
| 6,520,548 | B1 * | 2/2003 | Fisher et al. | 292/201 |
| 6,679,531 | B2 * | 1/2004 | Rogers et al. | 292/216 |
| 6,719,356 | B2 * | 4/2004 | Cleland et al. | 296/146.8 |
| 7,059,640 | B2 * | 6/2006 | Tensing et al. | 292/201 |
| 8,474,887 | B2 * | 7/2013 | Suzuki et al. | 292/201 |
| 2002/0040551 | A1 * | 4/2002 | Zhou | E05B 83/16 49/339 |
| 2004/0124662 | A1 * | 7/2004 | Cleland et al. | 296/146.4 |
| 2005/0155289 | A1 * | 7/2005 | Oberheide | 49/340 |
| 2006/0181108 | A1 * | 8/2006 | Cleland et al. | 296/146.4 |
| 2007/0079556 | A1 * | 4/2007 | Oberheide | 49/324 |
| 2012/0299313 | A1 * | 11/2012 | Organek et al. | 292/129 |
| 2015/0283886 | A1 * | 10/2015 | Nania | |

* cited by examiner

HATCH ARRANGEMENT FOR A MOTOR VEHICLE

CROSS-REFERENCES

This application claims the benefit of U.S. Provisional Application No. 62/040,227, filed Aug. 21, 2014, the content of which is hereby incorporated herein by reference in its entirety.

FIELD OF THE INVENTION

This disclosure is directed to a hatch arrangement for a motor vehicle, and to a hatch drive arrangement for such a hatch arrangement.

BACKGROUND

Presently, the expression "hatch arrangement" is to be understood in a broad sense. It includes in particular any kind of doors of a motor vehicle such a side doors or back doors as well as tailgates, lift gates, trunk lids or engine hoods.

From the prior art and in particular DE 20 2012 004 789 U1 a power tailgate with a cinching system is known. Once the catch of the hatch lock of the tailgate has reached the secondary latch position—whether through manual movement of the tailgate or powered movement of the tailgate or a combination thereof—the cinching system acts on the catch to pull it from a secondary latch position to the primary latch position, thereby ensuring an automatic closing of the hatch which is secure and complete. For a correct timing of the activation of such a cinching system and in order to overcome the seal pressure, which acts against the completion of the closing of the tailgate, such a cinching system relies on switch signals and comprises an actuator able to exert a force sufficient to overcome e.g. the seal pressure. Such a cinching system must not only not interfere with the standard latching functions, but it also needs to detect and react to malfunctions during the cinching process. In addition, after having moved the catch of the hatch lock to the primary latch position, a reversal movement of the actuator of the cinching system is usually required. Because this reversal movement takes place at a time when no visible parts of the hatch are moving, any resulting noise is perceived as annoying and potentially misunderstood as a malfunction by an occupant of the motor vehicle. Finally, for wet area applications additional sealing may be necessary for the cinching system and its associated wiring.

SUMMARY

In some cases embodiments of the invention improve a known hatch arrangement with a cinching system to make it more simple and more robust in its construction and to overcome drawbacks such as those described above. On aspect that will be described relates to a hatch arrangement. Another aspect that will be described relates to a hatch drive arrangement for a hatch arrangement.

The basic idea underlying the invention is to use any regular hatch drive, such as a spindle drive, which is used to move a hatch leaf from e.g., a closed position to an open position as part of a power tailgate functionality, to also act as a cinching drive that can be used to move a cinching catch of the hatch arrangement to a fully closed position. This combined functionality is made possible by having the hatch drive be coupled to the cinching catch of the hatch leaf, and thereby indirectly to the hatch leaf. This coupling is such that when the hatch leaf is in a position substantially away from its fully closed position and in particular in an open hatch position, the hatch drive substantially acts to move the hatch leaf, but at first does not act to move the cinching catch for engaging the corresponding cinching striker. Such a movement for engaging could for example be a pivoting movement.

Only when the hatch leaf is almost fully closed, for example at the point where the cinching catch makes contact with the cinching striker, does the hatch drive act to move the cinching catch e.g., by pivoting such that it receives the cinching striker and moves into the fully closed position. Thereby, also the hatch lock catch is moved to its primary latch position. The result is a simple construction which obviates the need for an additional actuator to the already existing hatch drive and for complicated signal processing. Another benefit is that such a cinching system may be interchangeably used with a system without cinching for an identical hatch leaf.

Some implementations make use of the fact that a pivotable cinching catch enables precise control over the point at which the cinching catch engages in a pivoting movement as the hatch leaf closes. This also permits to use a variation in the lever arm of the hatch drive acting on the cinching catch to overcome the increasing seal pressure acting on the hatch leaf as the cinching catch is moved to its fully closed position.

In some cases, a spindle drive—which is an advantageous drive solution for a hatch drive arrangement—is also preferably used for doubling as a cinching drive, i.e., for moving the cinching catch to its closed position. Some implementations concern arrangements of such a hatch drive arrangement with regard to the body of the motor vehicle of which the hatch drive arrangement is a part. The hatch drive arrangement may optionally be coupled to the hatch lock latch itself, in which case the cinching catch would be the hatch lock latch and the hatch lock striker the corresponding cinching strike. Therefore, no separate cinching catch would be required.

A further implementation, makes use of the fact that a single spindle drive can be a sufficiently powerful actuator for a cinching mechanism to a hatch leaf with two cinching catches, e.g., with a cinching catch on either side of a tailgate. Thus, despite having several cinching catches, only a single drive is required.

According to an aspect, a hatch arrangement for a motor vehicle has a hatch leaf movable between an open hatch position and a closed hatch position, a cinching catch for engaging a cinching striker of the motor vehicle, which cinching catch is movably coupled to the hatch leaf, and a hatch drive arrangement for moving the hatch leaf, wherein the hatch drive arrangement is coupled with the cinching catch for moving the cinching catch.

In some implementations, the cinching catch is pivotable toward a closed catch position for engaging the cinching striker in a retaining manner and toward an open catch position for disengaging the striker. In such cases the cinching catch may be pivotable around a catch axis.

In some implementations, the hatch drive arrangement is coupled to the cinching catch at a coupling point, which coupling point is offset from the catch axis.

In some implementations, moving the hatch leaf between the open hatch position and the closed hatch position causes a pivoting of the cinching catch. A movement of the hatch leaf toward the closed hatch position may optionally cause a pivoting of the cinching catch toward the closed catch position.

In some implementations, the effective lever arm of a force exerted by the hatch drive arrangement on the cinching catch with respect to the catch axis varies with a movement of the hatch leaf between the open hatch position and the closed hatch position. The effective lever arm of the force exerted by the hatch drive arrangement on the cinching catch increases with the movement of the hatch leaf toward the closed hatch position.

In some implementations, the cinching catch engages the cinching striker at an engagement hatch position such that the cinching striker exerts a torque on the cinching catch toward the closed catch position.

In some implementations, the hatch drive arrangement includes a spindle drive.

In some implementations, the hatch leaf is pivotably coupled around a hatch axis with a body of the motor vehicle. In some cases the hatch axis is substantially parallel to the catch axis.

In some implementations the hatch drive arrangement is pivotably coupled around a drive axis to the body of the motor vehicle. The drive axis may be offset from the hatch axis such that a hatch angle between the hatch drive arrangement and the hatch leaf is less than 45°, and in some cases, less than 20°.

In some implementations the hatch arrangement includes a hatch lock arranged on the hatch leaf. The hatch lock includes a hatch lock catch for engaging a hatch lock striker in a retaining manner in a primary latch position and in a secondary latch position and for disengaging the striker in an open latch position.

In some cases the hatch arrangement comprises a hatch drive controller for controlling the hatch drive arrangement. For example, the hatch drive controller may cause the hatch drive arrangement to exert a torque on the cinching catch such that the hatch lock latch is moved from the secondary latch position to the primary latch position.

In some implementations the hatch drive controller is configured to control a driving speed of the hatch drive arrangement, such as a speed of the spindle drive.

In some implementations the cinching catch is coupled to the hatch leaf at a coupling point substantially midway between the hatch axis and the hatch lock. In some implementations the cinching catch is provided by the hatch lock catch and the cinching striker is the hatch lock striker. In some implementations the hatch arrangement comprises two cinching catches for each engaging a cinching striker of the motor vehicle. The hatch drive arrangement in this case includes a single hatch drive, e.g., a single spindle drive, configured to drive a first cinching catch of the cinching catches. In some cases a second cinching catch of the cinching catches is coupled with the first cinching catch so as to drive the second cinching catch synchronously to the first cinching catch.

Another aspect of the invention relates to a hatch drive arrangement for a hatch arrangement. For example, the hatch drive arrangement could be configured according to any of the above examples and/or further teachings provided herein.

BRIEF DESCRIPTION OF THE DRAWINGS

Aspects and implementations of the invention will be described hereinafter with reference to the figures, in which.

DETAILED DESCRIPTION

Figure 1:
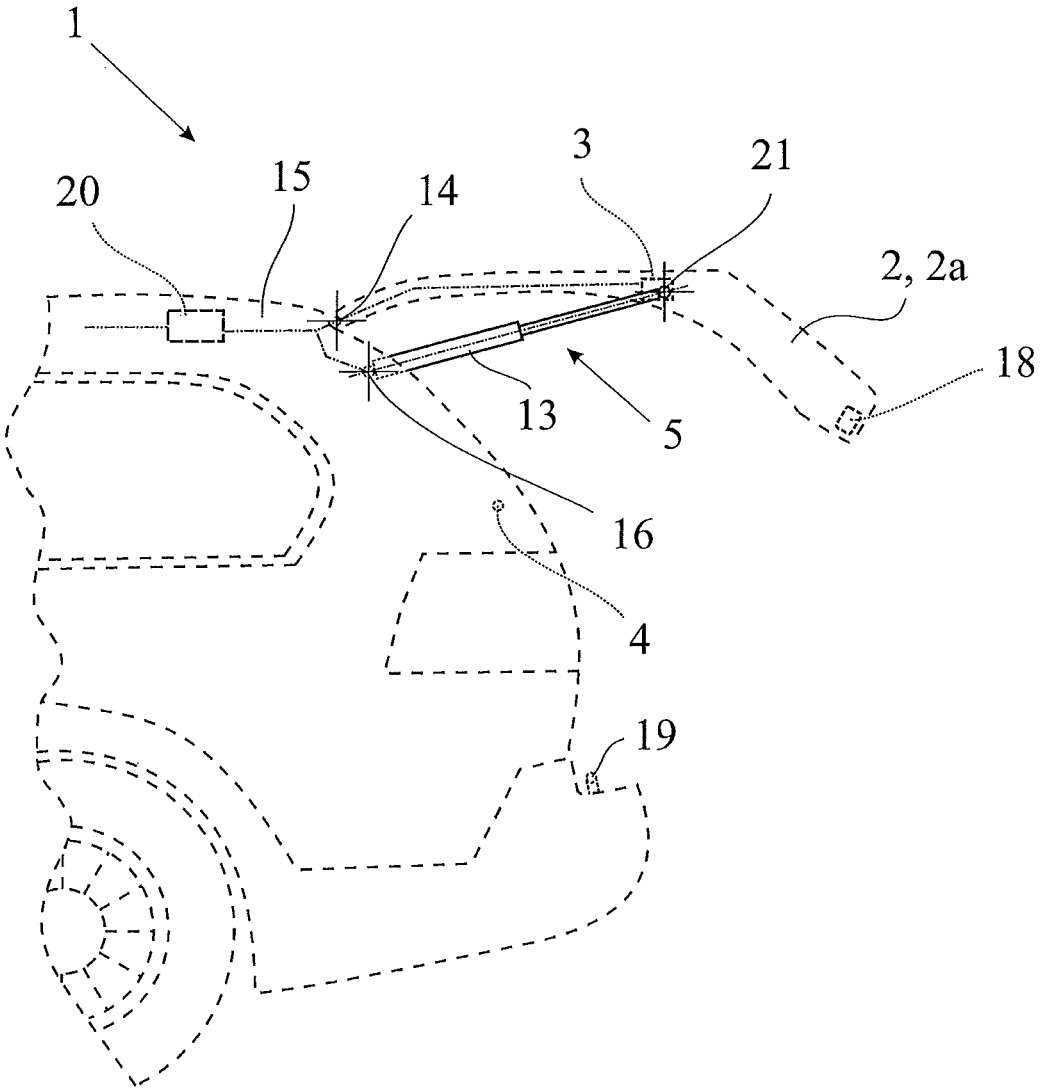
FIG. 1 is a schematic side view of a motor vehicle with a hatch arrangement according to the proposal.
Figure 3A:
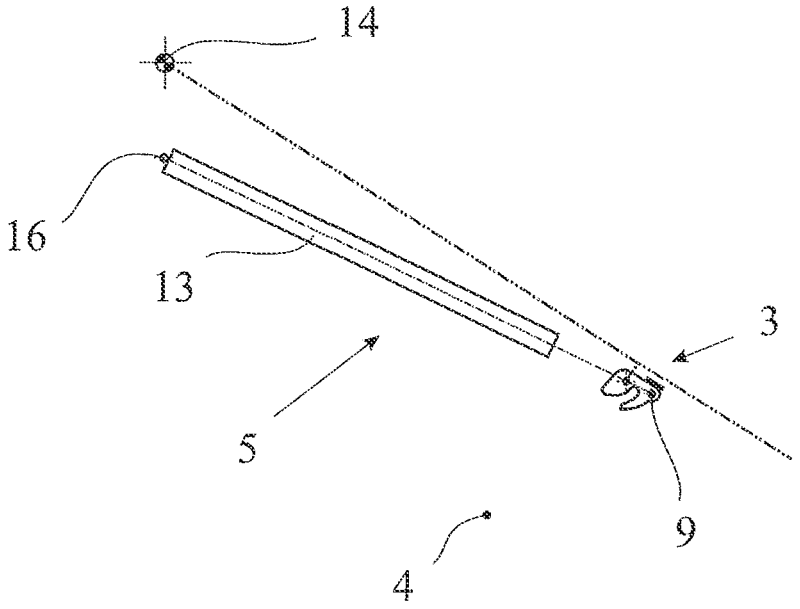
FIGS. 3*a* and 3*b* are schematic views of the hatch arrangement of FIG. 1 in a substantially open position of the hatch leaf.
Figure 5A:
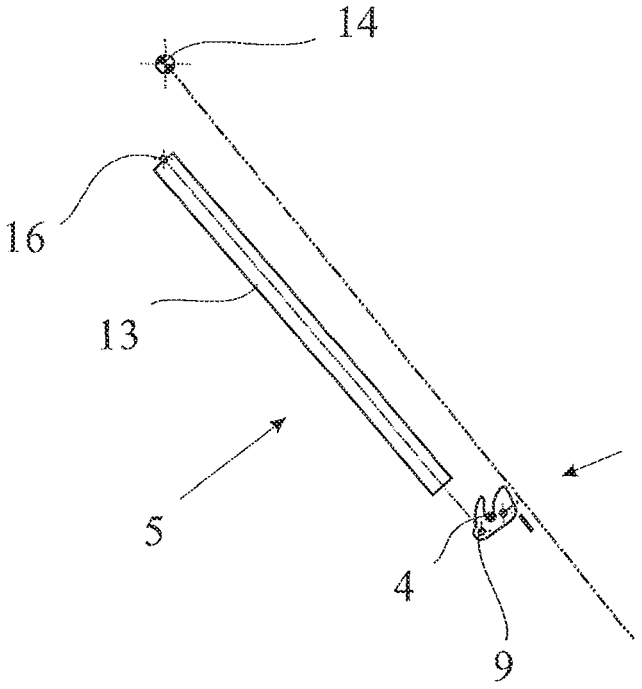
FIGS. 5*a* and 5*b* are schematic views of the hatch arrangement of FIG. 1 in a fully closed position of the hatch leaf and a closed catch position of the cinching catch.

The hatch arrangement shown in the drawings is assigned to a motor vehicle 1 shown partially in FIG. 1. The hatch arrangement comprises a hatch leaf 2—in the embodiment shown that hatch leaf 2 is a tailgate 2*a*—movable between an open hatch position and a closed hatch position. The hatch arrangement may also be any other kind of door of a motor vehicle, such as a sliding door. The open hatch position is shown in FIG. 1 and FIGS. 3*a, b* and the closed hatch position in FIGS. 5*a, b*. The hatch arrangement further comprises a cinching catch 3 for engaging a cinching striker 4 of the motor vehicle 1. The cinching catch 3 is movably coupled to the hatch leaf 2. The hatch arrangement further comprises a hatch drive arrangement 5 for moving the hatch leaf 2. In particular, the hatch drive arrangement 5 may be configured for moving the hatch leaf 2 between the open hatch position and the closed hatch position in one or both directions.

The hatch leaf 2 may in addition also be moved manually. The hatch arrangement may comprises further devices, such as for example springs, that—in addition to the hatch drive arrangement 5—may exert a moving or pre-tensioning force on the hatch leaf 2 toward the closed hatch position or the open hatch position in some or all positions of the hatch leaf 2. The weight of the hatch leaf 2 further causes a force toward the closed hatch position.

The proposed hatch arrangement is characterized in that the hatch drive arrangement 5 is coupled with the cinching hatch 3 for moving the cinching hatch 3. By thus moving the cinching hatch 3, the hatch leaf 2 is also moved. Consequently, any force exerted by the hatch drive arrangement 5 to move the hatch leaf 2 is transmitted via the cinching catch 3 to the hatch leaf 2. The hatch drive arrangement 5 thus moves the hatch leaf 2 indirectly.

Figure 2:
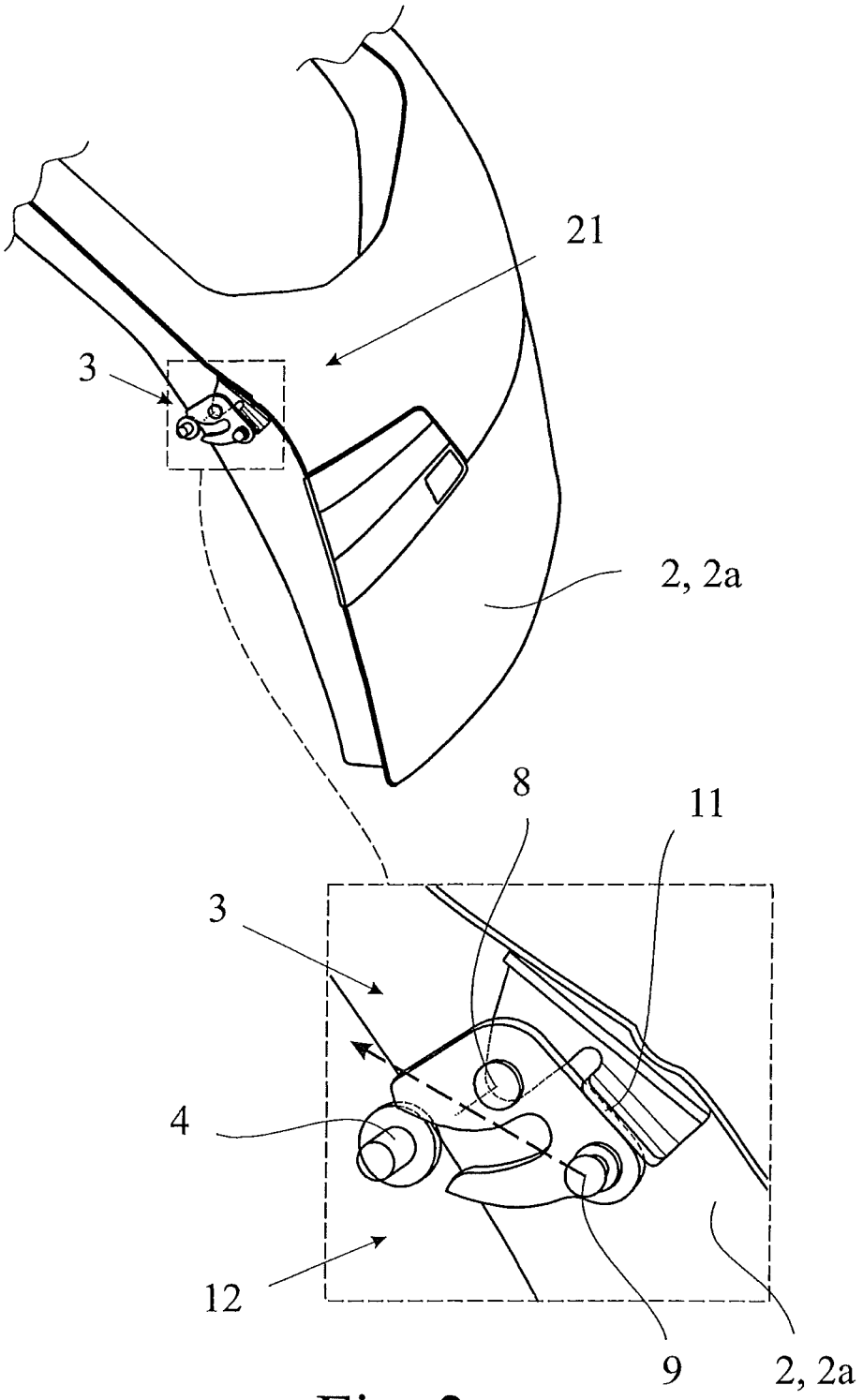
FIG. 2 is a more detailed view of a part of the hatch arrangement of FIG. 1.
Figure 3B:
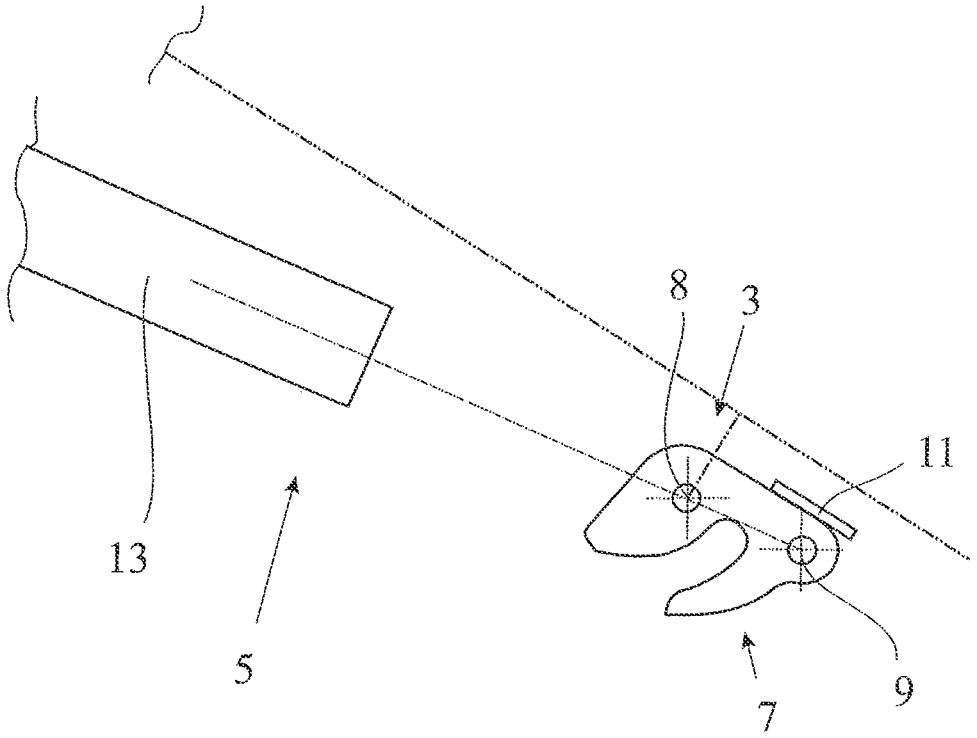
Figure 5B:
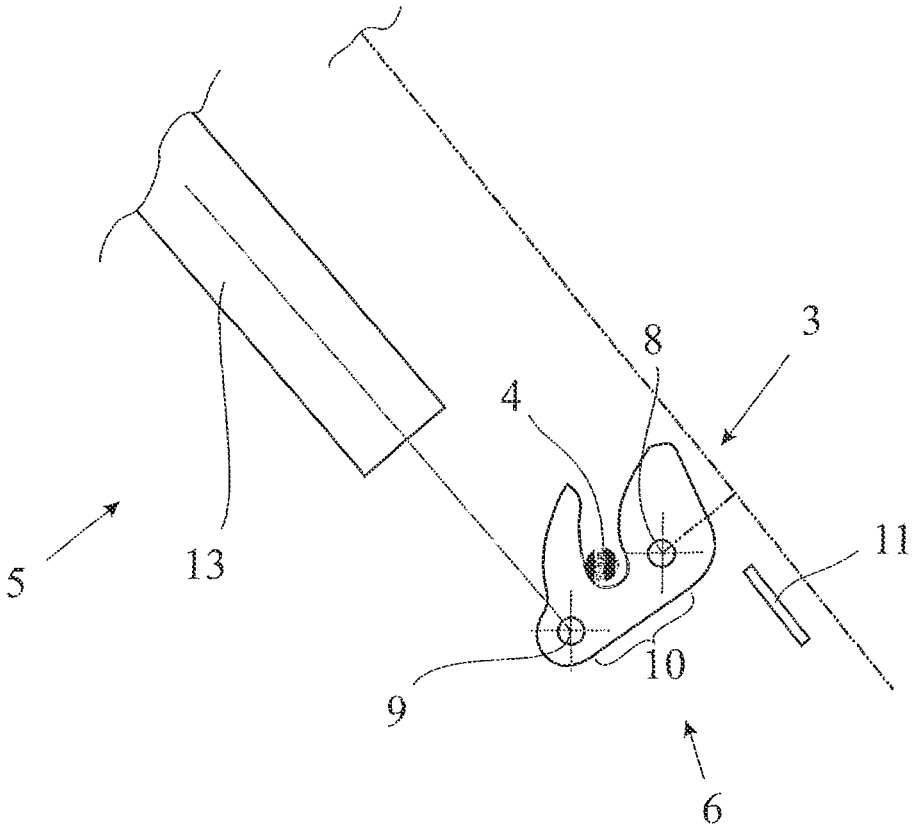

In an embodiment, the cinching catch 3 is pivotable toward a closed catch position 6 for engaging the cinching striker 4 in a retaining manner. The closed catch position 6 of the cinching catch 3 is shown in an enlarged view in FIG. 5*b*. The cinching catch 3 is also pivotable toward an open catch position 7 for disengaging the cinching striker 4. This open catch position 7 is shown in an enlarged view in FIG. 3*b*. In this implementation, the cinching catch 3 is pivotable around a catch axis 8. A more detailed view of the cinching catch 3, in particular in relation to the hatch leaf 2 and the cinching striker 4, is shown in FIG. 2.

Figure 4A:
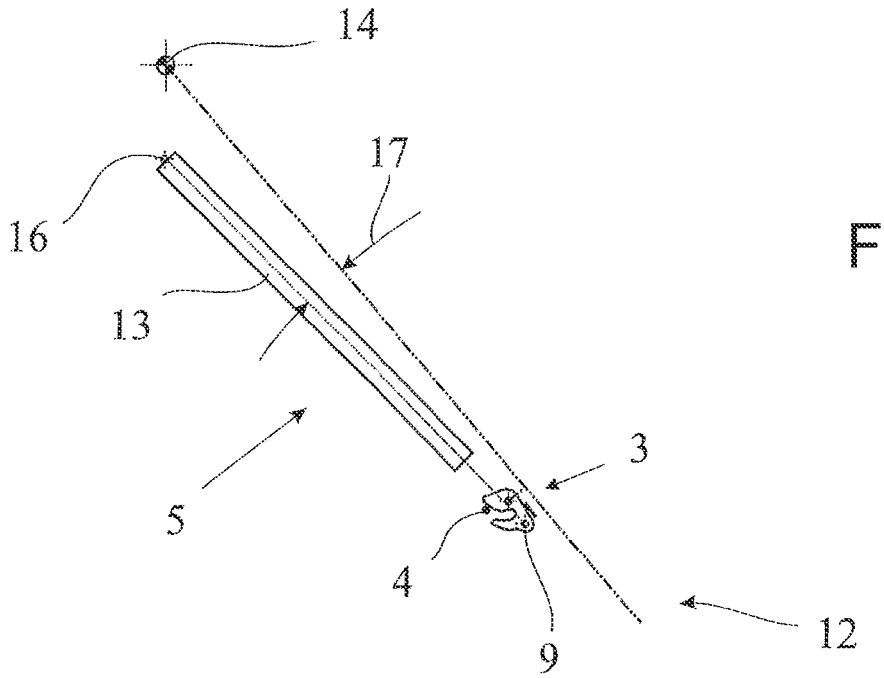
FIGS. 4 *a* and 4*b* are schematic views of the hatch arrangement of FIG. 1 in a position of the hatch leaf in which the cinching mechanism starts to cause a pivoting of the cinching catch.
Figure 4B:
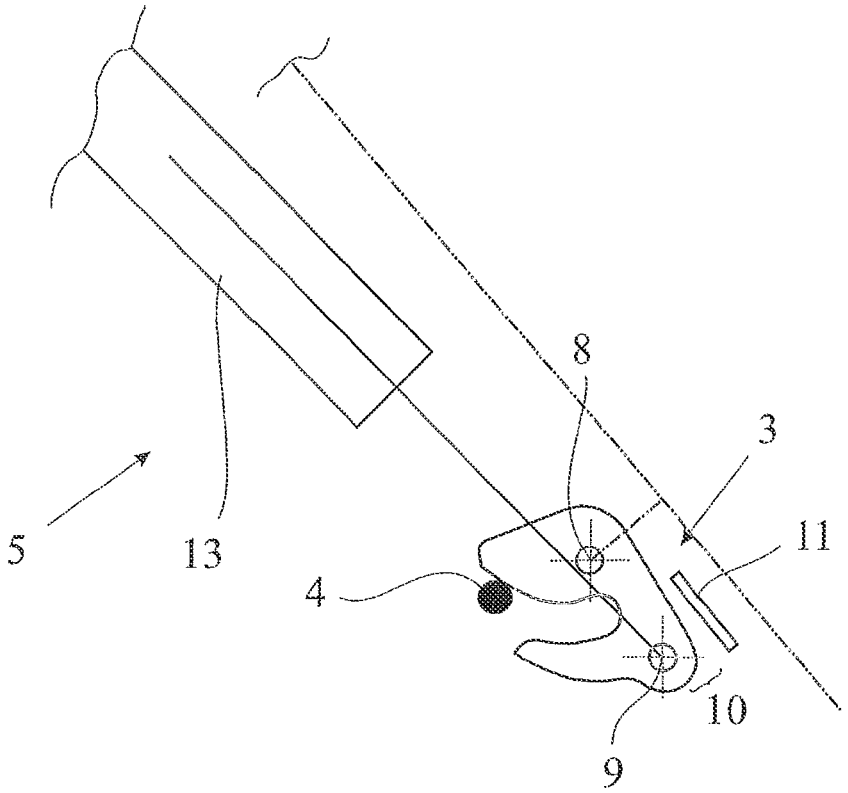

Further, as shown in the drawings, the hatch drive arrangement 5 is coupled to the cinching catch 3 at a coupling point 9, which coupling point 9 is offset from the catch axis 8. Therefore, by exerting a force on this coupling point 9, the hatch drive arrangement 5 can exert a torque on the cinching catch 3, which torque in particular depends on the pivoting position of the cinching catch 3 with respect to the catch axis 8. This is illustrated by a comparison of FIG. 3*b*, FIG. 4*b* and FIG. 5*b*, based on assuming a constant force exerted by the hatch drive arrangement 5. It can be seen that in the situation of FIG. 3*b*, a force exerted by the hatch drive arrangement 5 on the cinching catch 3 does not result in a substantial torque exerted on the cinching catch 3 because there is substantially no effective lever arm for that force. In the situation of FIG. 4*b*, there is a small effective lever arm 10, resulting in a comparatively small torque exerted on the cinching catch 3 by the hatch drive arrangement 5. On the other hand the effective lever arm 10 is comparatively large in the situation according to FIG. 5*b*, thereby resulting in a proportionally greater torque exerted by the drive arrangement 5 on the cinching catch 3.

It is noted that even if a torque is exerted by the drive arrangement 5 on the cinching catch 3, a substantial pivoting of the cinching catch 3 does not necessary follow. For example there could be—as is the case for the present embodiment but not shown in the figures—a pre-tensioning spring exerting a torque in the counter-clockwise direction on the cinching catch 3.

Thereby, a pivoting of the cinching catch 3 in the clockwise direction only results when the torque of this pre-tensioning spring is overcome. To prevent the cinching catch 3 of the present embodiment from pivoting further in the counterclockwise direction, the hatch arrangement also comprises a stop plate 11.

It some cases moving the hatch leaf 2 between the open hatch position and the closed hatch position causes a pivoting of the cinching catch 3. In particular, the movement of the hatch leaf 2 toward the closed hatch position can cause a pivoting of the cinching catch 3 toward the closed catch position 6. It is noted that such a pivoting is not necessarily caused during the entire course of movement between the open hatch position and the closed hatch position. It may be that such pivoting is caused only at one position of that course of movement or on a section of that course.

Further, the effective lever arm 10 of a force exerted by the hatch drive arrangement 5 on the cinching catch 3 with respect to the catch axis 8 can vary with a movement of the hatch leaf 2 between the open hatch position and the closed hatch position. This was already pointed out above in discussing the effective lever arm 10 in the situations corresponding to FIG. 3*b*, FIG. 4*b*, and FIG. 5*b*.

As already observed with regard to the pivoting of the cinching catch 3, also this variation of the effective lever arm 10 may only apply at a certain position on the course of movement of the hatch leaf 2 or on a certain section on that course of movement of the hatch leaf 2 between the open hatch position and the closed hatch position. Here the effective lever arm 10 of the force exerted by the hatch drive arrangement 5 on the cinching catch 3 increases with the movement of the hatch leaf 2 toward the closed hatch position.

The pivoting of the cinching catch 3 at some point between the open hatch position and the closed hatch position of the hatch leaf 2 may be caused by principally any suitable mechanism. According to the present embodiment, the cinching catch 3 engages the cinching catch 4 at an engagement hatch position 12 such that the cinching striker 4 exerts a torque on the cinching catch 3 toward the closed catch position 6. This engagement hatch position 12 is depicted in FIG. 2 and FIGS. 4*a, b*. By means of this engagement, the cinching striker 4 causes a pivoting of the cinching catch 3 such that with increasing pivoting of the cinching catch 3, the effective lever arm 10 becomes larger, thereby allowing the hatch drive arrangement 5 to exert increasingly more torque on the cinching catch 3. This is particularly advantageous to overcome the resistance of the seal of the hatch leaf 2—which seal is not shown here—against the closing of the hatch leaf 2, since this resistance of the seal also increases toward completion of the closing as the seal becomes increasingly deformed.

In some cases the hatch drive arrangement 5 includes a spindle drive 13. The hatch drive arrangement 5 may also include any other kind of type of drive. In order for the hatch drive arrangement 5 to be equally effective for moving the hatch leaf 2 and for pivoting the cinching catch 3, the hatch leaf 2 may be pivotably coupled around a hatch axis 14 with the body 15 of the motor vehicle 1. In some cases this hatch axis 14 is substantially parallel to the catch axis 8.

In some cases the hatch drive arrangement 5 is pivotably coupled around a drive axis 16 to the body 15 of the motor vehicle 1. Here the drive axis 16 is offset from the hatch axis 14 such that a hatch angle 17 between the hatch drive arrangement 5 and the hatch leaf 2 is less than 45 degrees and in some cases even less than 20 degrees. For the purpose of determining this hatch angle 17, the direction of the hatch drive arrangement 5 may be understood to be the direction of the force exerted by the hatch drive arrangement 5. Such a hatch angle 17 permits a placement of the hatch drive arrangement 5 e.g., in a rainwater gutter associated with the hatch leaf 2.

In some cases the hatch arrangement includes a hatch lock 18 arranged on the hatch leaf 2, as shown only schematically in FIG. 1. According to this implementation, the hatch lock 18 includes a hatch lock catch for engaging a hatch lock striker 19 in a retaining manner in a primary latch position and in a secondary latch position and for disengaging the hatch lock striker 19 in an open latch position. The hatch lock 18 may further include a pawl for a blocking engagement with the hatch lock catch and a release actuation lever for deflecting the pawl as well as other components of a vehicle lock.

On the one hand, and as shown in FIG. 1, the hatch lock 18 may include the hatch arrangement in addition to the catching arrangement 3 and may—as also shown—be arranged at the end of the hatch leaf 2. In such a case, moving the cinching catch 3 as described above to the closed catch position 6 when engaging the cinching striker 4 would also—at least indirectly—result in movement of the hatch lock catch to the primary latch position. It is to be noted that the engagement of the cinching striker 4 by the cinching catch 3 may occur synchronously with the engagement of the hatch lock striker 19 by the hatch lock catch of the hatch lock 18. Alternatively, the engagement of the cinching striker 4 by the cinching catch 3 may also occur before or after the engagement of the hatch lock striker 19 by the hatch lock catch of the hatch lock 18. Thereby, the hatch arrangement according to the proposal can not only move the hatch lock catch from its secondary latch position to the primary latch position, but also starting from the open position all the way to the primary latch position.

In order to better control the action of the hatch drive arrangement 5 the hatch arrangement can include a hatch drive controller 20 for controlling the hatch drive arrangement 5. In some implementations, the hatch drive controller 20 causes the hatch drive arrangement 5 to exert a torque on the cinching catch 3 such that the hatch lock latch is moved from the secondary latch position to the primary latch position. The hatch lock latch may be moved thus from the open position to the primary latch position.

Further this hatch drive controller 20 is optionally configured to control a driving speed of the hatch drive arrangement 5 and in some cases a speed of the spindle drive 13. Such a hatch drive controller 20 can advantageously use the electronics that are regularly comprised by a spindle drive 13 to control the speed of the spindle drive 13. Such a control of the speed of the spindle drive 13 may be advantageous, e.g., for a squeeze protection functionality of the hatch leaf 2.

The hatch drive controller 20 may also react to the signal of an ajar switch associated with the hatch lock 18 or with an analogous signal based on a position of the cinching catch 3. The hatch drive controller 20 may further ensure that there is a sufficient over-travel of the pivoting of the cinching catch 3 when moving to the closed catch position 6 and/or of the hatch lock catch so that the hatch lock catch reliably reaches the primary latch position.

In one implementation, and as shown in FIG. 1, the cinching catch 3 is coupled to the hatch leaf 2 at a coupling point 21 substantially midway between the hatch axis 14 and the hatch lock 18.

It may also be that the cinching catch 3 is actually the catch of the hatch lock 18 of the hatch leaf 2, thereby obviating the need for a cinching catch 3 and a separate catch of the hatch lock 18 proper. Accordingly, in some cases the cinching catch 3 is provided by the hatch lock latch and the cinching striker 4 is the hatch lock striker 19. It follows that the hatch arrangement may include a pawl which may be brought into a blocking position for a blocking engagement with the cinching catch 3 and a release actuation lever for deflecting the pawl from the blocking position into a release position. This pawl and this release actuation lever may be the pawl and release actuation lever of the hatch lock 18.

In general, the hatch arrangement may include two cinching catches 3 associated with a corresponding cinching striker 4 each. The hatch drive arrangement 5 may equally include a separate spindle drive 13 for each cinching catch 3, with the cinching catches 3, the cinching strikers 4 and the spindle drives 13 each optionally arranged with lateral symmetry with respect to the motor vehicle 1.

However, in some implementations—not shown in the Figures—a single spindle drive 13 may be able to exert sufficient force to pivot both cinching catches 3—as well as the potential hatch lock catch of a separate hatch lock 18—of such an arrangement. Therefore, in this case the hatch drive arrangement 5 may be arranged unilaterally with respect to the hatch leaf 2.

Consequently it may be preferred that the hatch arrangement includes two cinching catches for each engaging a striker 4 of the motor vehicle and that the hatch drive arrangement 5 includes a single hatch drive, such as a single spindle drive 13, which is configured to drive a first cinching catch 3 of the cinching catches. In some cases a second cinching catch of the cinching catches is coupled with the first cinching catch 3 so as to drive the second cinching catch synchronously to the first cinching catch 3. Such a coupling may for example be implemented with a Bowden cable connection between the first cinching catch 3 and the second cinching catch.

Further, a hatch drive arrangement for a hatch arrangement according to the proposal and any of its implementations and/or features is thus disclosed.

Thus, embodiments of the invention are disclosed. Although the present invention has been described in considerable detail with reference to certain disclosed embodiments, implementations, and features, these are presented for purposes of illustration and not limitation and other embodiments, implementations, and features of the invention are possible. One skilled in the art will appreciate that various changes, adaptations, and modifications may be made without departing from the spirit of the invention and the scope of the appended claims.

The invention claimed is:

1. A hatch arrangement for a motor vehicle, the hatch arrangement comprising:

a rear hatch leaf pivotally movable between an open hatch position and a closed hatch position;

a cinching catch movably coupled to the hatch leaf, the cinching catch configured to engage a cinching striker of the motor vehicle; and a hatch drive arrangement configured to pivot the hatch leaf between the open hatch position and the closed hatch position;

wherein the hatch drive arrangement is coupled with the cinching catch and configured to move the cinching catch;

wherein the cinching catch is unable to engage the cinching striker when the hatch leaf is in the open hatch position;

wherein the cinching catch is pivotable toward a closed catch position for engaging the cinching striker in a retaining manner and toward an open catch position for disengaging the striker; and wherein the cinching catch is pivotable around a catch axis.

2. The hatch arrangement according to claim 1, wherein the hatch drive arrangement is coupled to the cinching catch at a coupling point that is offset from the catch axis.

3. The hatch arrangement according to claim 2, wherein moving the hatch leaf between the open hatch position and the closed hatch position causes a pivoting of the cinching catch.

4. The hatch arrangement according to claim 3, wherein a movement of the hatch leaf toward the closed hatch position causes a pivoting of the cinching catch toward the closed catch position.

5. The hatch arrangement according to claim 2, wherein an effective lever arm of a force exerted by the hatch drive arrangement on the cinching catch with respect to the catch axis varies with a movement of the hatch leaf between the open hatch position and the closed hatch position.

6. The hatch arrangement according to claim 5, wherein the effective lever arm of the force exerted by the hatch drive arrangement on the cinching catch increases with the movement of the hatch leaf toward the closed hatch position.

7. The hatch arrangement according to claim 1, wherein the cinching catch engages the cinching striker at an engagement hatch position such that the cinching striker exerts a torque on the cinching catch toward the closed catch position.

8. The hatch arrangement according to claim 1, wherein the hatch drive arrangement comprises a spindle drive.

9. The hatch arrangement according to claim 1, wherein the hatch leaf is pivotably coupled around a hatch axis with a body of the motor vehicle, and wherein the hatch axis is substantially parallel to the catch axis.

10. The hatch arrangement according to claim 9, wherein the hatch drive arrangement is pivotably coupled around a drive axis to the body of the motor vehicle.

11. The hatch arrangement according to claim 10, wherein the drive axis is offset from the hatch axis such that a hatch angle between the hatch drive arrangement and the hatch leaf is less than 45°.

12. The hatch arrangement according to claim 9, wherein the hatch arrangement comprises a hatch lock arranged on the hatch leaf, the hatch lock comprising a hatch lock catch for engaging a hatch lock striker in a retaining manner in a primary latch position and in a secondary latch position, and for disengaging the striker in an open latch position.

13. The hatch arrangement according to claim 12, wherein the hatch arrangement comprises a hatch drive controller for controlling the hatch drive arrangement, wherein the hatch drive controller causes the hatch drive arrangement to exert a torque on the cinching catch such that the hatch lock latch is moved from the secondary latch position to the primary latch position.

14. The hatch arrangement according to claim 13, wherein the hatch drive controller is configured to control a driving speed of the hatch drive arrangement.

15. The hatch arrangement according to claim 12, wherein the cinching catch is coupled to the hatch leaf at a coupling point substantially midway between the hatch axis and the hatch lock.

16. The hatch arrangement of claim 12, wherein the cinching catch is provided by the hatch lock catch and the cinching striker is the hatch lock striker.

17. The hatch arrangement according to claim 1, wherein the hatch arrangement comprises two cinching catches for each engaging a cinching striker of the motor vehicle, wherein the hatch drive arrangement comprises a single hatch drive configured to drive a first cinching catch of the two cinching catches, and wherein a second cinching catch of the two cinching catches is coupled with the first cinching catch so as to drive the second cinching catch synchronously to the first cinching catch.

18. A hatch arrangement for a motor vehicle, the hatch arrangement comprising:

a rear hatch leaf pivotally movable between an open hatch position and a closed hatch position;

a cinching catch movably coupled to the hatch leaf, the cinching catch configured to engage a cinching striker of the motor vehicle; and a hatch drive arrangement configured to pivot the hatch leaf between the open hatch position and the closed hatch position;

wherein the hatch drive arrangement is coupled with the cinching catch and configured to move the cinching catch;

wherein the cinching catch is unable to engage the cinching striker when the hatch leaf is in the open hatch position; and wherein the hatch drive arrangement comprises a spindle drive.

19. A hatch arrangement for a motor vehicle, the hatch arrangement comprising:

a rear hatch leaf pivotally movable between an open hatch position and a closed hatch position;

a cinching catch movably coupled to the hatch leaf, the cinching catch configured to engage a cinching striker of the motor vehicle; and a hatch drive arrangement configured to pivot the hatch leaf between the open hatch position and the closed hatch position;

wherein the hatch drive arrangement is coupled with the cinching catch and configured to move the cinching catch;

wherein the cinching catch is unable to engage the cinching striker when the hatch leaf is in the open hatch position; and wherein the hatch arrangement comprises two cinching catches for each engaging a cinching striker of the motor vehicle, wherein the hatch drive arrangement comprises a single hatch drive configured to drive a first cinching catch of the two cinching catches, and wherein a second cinching catch of the two cinching catches is coupled with the first cinching catch so as to drive the second cinching catch synchronously to the first cinching catch.

* * * * *